United States Patent [19]

Bossard et al.

[11] Patent Number: 4,913,031

[45] Date of Patent: Apr. 3, 1990

[54] VIBRATION DAMPING DEVICE FOR IMPROVING THE HIT ACCURACY OF A FIRING WEAPON

[75] Inventors: Werner Bossard, Zürich; Thomas Pesek, Winterthur, both of Switzerland

[73] Assignee: Werkzeugmaschinenfabrik Oerlikon-Buhrle, Zürich, Switzerland

[21] Appl. No.: 366,456

[22] Filed: Jun. 15, 1989

[30] Foreign Application Priority Data

Jun. 26, 1988 [CH] Switzerland ..... 02450/88

[51] Int. Cl.[4] ..... F41F 17/12

[52] U.S. Cl. ..... 89/14.3; 42/1.06

[58] Field of Search ..... 89/14.3, 14.4, 14.5, 89/14.05, 44.01; 42/1.06

[56] References Cited

U.S. PATENT DOCUMENTS

| | | | |
|---|---|---|---|
| 2,115,028 | 4/1938 | Logan | 89/44.01 |
| 2,381,130 | 8/1945 | Lloyd | 89/44.01 |
| 2,414,250 | 1/1947 | Williams | 42/71.01 |
| 2,625,235 | 1/1953 | Caulkins | 89/14.05 |
| 3,191,330 | 6/1965 | Olson | 42/1.06 |
| 3,208,348 | 9/1965 | Lee | 89/14.05 |
| 3,340,641 | 9/1967 | Recker | 42/97 |
| 4,040,331 | 8/1977 | Litman | 89/14.05 |
| 4,483,235 | 11/1984 | Hallquist | 89/14.05 |
| 4,638,714 | 1/1987 | Heintz et al. | 89/14.05 |

FOREIGN PATENT DOCUMENTS

| | | | |
|---|---|---|---|
| 2238834 | 2/1974 | Fed. Rep. of Germany | 89/14.4 |
| 2347642 | 4/1975 | Fed. Rep. of Germany . | |
| 449013 | 4/1950 | Italy | 89/44.01 |
| 4631 | 9/1907 | United Kingdom | 89/14.3 |
| 233709 | 1/1926 | United Kingdom | 89/14.3 |
| 599586 | 2/1944 | United Kingdom | 89/44.01 |

*Primary Examiner*—Charles T. Jordan
*Assistant Examiner*—Stephen Johnson
*Attorney, Agent, or Firm*—Werner W. Kleeman

[57] ABSTRACT

In the case of weapon barrels which are only secured at one of their ends at the weapon housing during firing of the weapon there occurs, particularly during series firing, bending vibrations or oscillations which impair the hit probability of the fired projectiles. In order to preclude or at least dampen such bending vibrations of the weapon barrel the invention contemplates securing a vibration damping device or damper at the muzzle of the weapon barrel. This vibration damper comprises an inertia body which is resiliently connected with the weapon barrel muzzle. Also provided is a brake device which dampens the movement of the inertia body relative to the weapon barrel. The inertia body preferably comprises two ring members which are pressed by springs against two disc members which are rigidly attached to the weapon barrel muzzle. Between the weapon barrel and the ring members of the inertia body there are arranged resilient elements, such as blade or leaf springs.

8 Claims, 2 Drawing Sheets

VIBRATION DAMPING DEVICE FOR IMPROVING THE HIT ACCURACY OF A FIRING WEAPON

BACKGROUND OF THE INVENTION

The present invention relates to a new and improved construction of vibration damping device for improving the hit accuracy of projectiles which are fired from a firing weapon.

In its more particular aspects, the present invention relates to an improved vibration damping device or damper for improving the hit accuracy of a firing weapon comprising a weapon barrel muzzle. The vibration damping device or damper is provided for the weapon barrel muzzle and prevents the weapon barrel which is only secured at one end from carrying out bending vibrations or oscillations during firing of projectiles or rounds of ammunition from the weapon barrel of the firing weapon. There is also provided an inertia body or body member which is resiliently connected with the weapon barrel muzzle.

In the case of weapon barrels of firing weapons which are only attached at one end at the weapon housing and where the weapon barrel is relatively long and slender, there exists the danger that the weapon barrel will tend to perform bending vibrations or oscillations during firing of projectiles or rounds of ammunition out of the weapon barrel. Such bending vibrations undesirably alter the hit accuracy of the fired projectiles and impair the hit probability.

SUMMARY OF THE INVENTION

Therefore with the foregoing in mind it is a primary object of the present invention to provide a new and improved construction of vibration damping device or damper for improving the projectile hit accuracy of a firing weapon.

Another and more specific object of the present invention aims at the provision of a new and improved construction of a vibration damping device which effectively precludes or at least dampens bending vibrations or oscillations of the weapon barrel of a firing weapon during firing of projectiles or rounds of ammunition therefrom.

Still a further significant object of the present invention aims at the provision of an improved construction of vibration damping device for use with firing weapons in order to dampen possibly arising vibrations or oscillations of the weapon barrel, particularly during series firing, in other words the successive firing of a number of projectiles or rounds of ammunition from the firing weapon.

A further noteworthy object of the present invention is directed to an improved vibration damping device for firing weapons, which is relatively simple in construction and design, quite reliable in operation, economical to manufacture by virtue of its containing relatively few parts, and not readily subject to breakdown.

Now in order to implement these and still further objects of the invention, which will become more readily apparent as the description precedes, the vibration damping device or vibration damper of the present development, among other things, is manifested by the features that the inertia body or body member possesses a substantially ring-shaped or annular construction and is arranged substantially coaxially with respect to the lengthwise axis of the weapon barrel and is retained in this position by a number of resilient elements, such as blade or leaf springs.

According to a preferred construction the vibration damper preferably possesses an inertia body which is resiliently connected with the muzzle of the weapon barrel. This inertia body, as previously noted, is for instance of ring-shaped configuration and arranged coaxially with respect to the lengthwise axis of the weapon barrel and retained in this position by a number of resilient elements or springs, especially the aforementioned blade or leaf springs. The movement of the inertia body relative to the weapon barrel can be dampened by a brake device containing braking or brake surfaces which are resiliently pressed against one another. The substantially ring-shaped or annular inertia body can be located between two disc members or discs rigidly attached to the weapon barrel muzzle and can comprise two ring members or rings which are resiliently pressed against both of the disc members.

The one ring member of the inertia body can possess a plurality of axial bores in which there are located compression or pressure springs which press both of the ring members of the inertia body against both of the disc members which are rigidly attached to the weapon barrel muzzle. The blade or leaf springs can be each secured at their one end at the weapon barrel muzzle and can bear at their other end at the inner side of surface of the substantially ring-shaped inertia body. Between both of the disc members which are rigidly attached at the weapon barrel muzzle there can be arranged pin members directed substantially parallel to the lengthwise or longitudinal axis of the weapon barrel. The blade or leaf springs are each anchored at one of their ends at an associated pin members.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
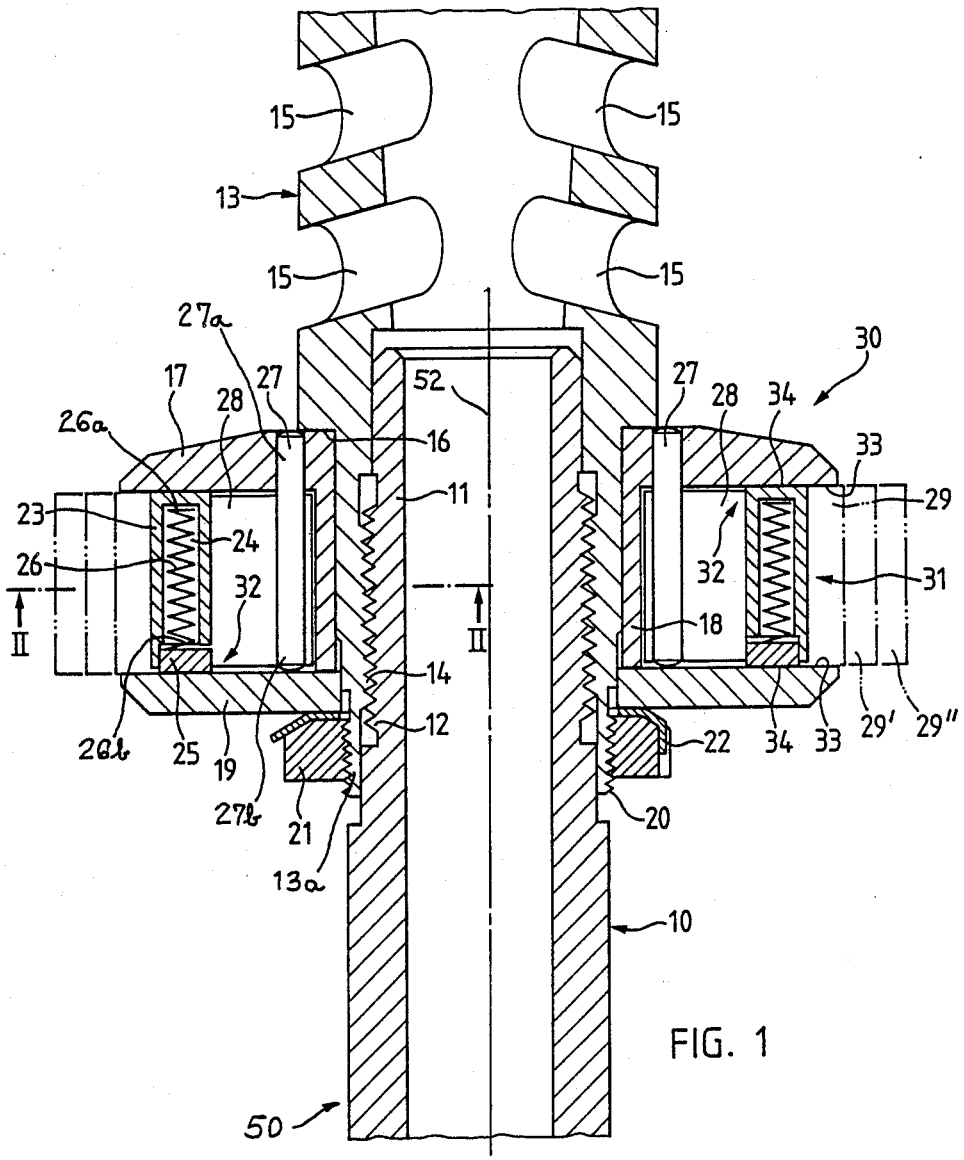
FIG. 1 is a fragmentary longitudinal sectional view through part of a firing weapon depicting the weapon barrel and specifically the weapon barrel and muzzle equipped with the weapon barrel-vibration damping device or damper.
Figure 2:
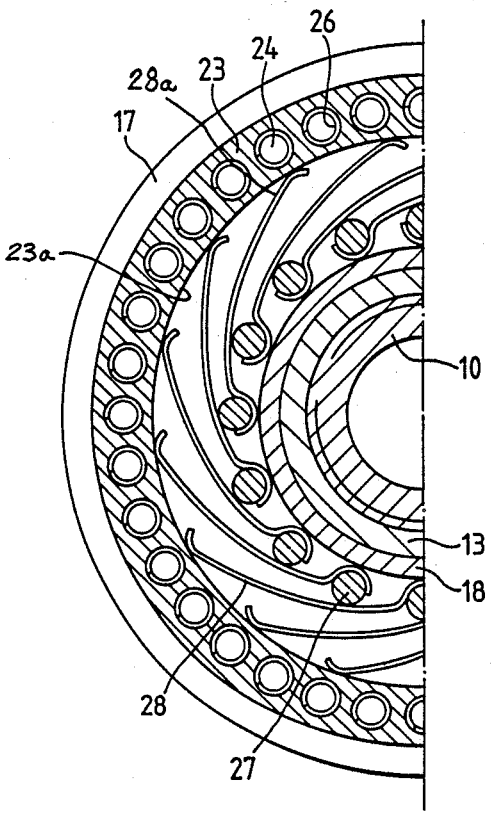
FIG. 2 is a partial cross-sectional view through the arrangement of FIG. 1.

Describing now the drawings, it is to be understood that in order to simplify the illustration thereof, only enough of the construction of the firing weapon and the associated weapon barrel equipped with the inventive vibration damping device or vibration damper is shown as needed for one skilled in the art to readily understand the underlying principles and concepts of the present development. Turning attention now to FIG. 1, there will be recognized a suitable firing weapon, generally indicated by reference character 50, which comprises a weapon barrel 10 having a lengthwise or longitudinal axis 52 and including a weapon barrel muzzle 11. This weapon barrel muzzle 11 is provided with external threads or threading 12. A suitable barrel muzzle brake or brake device 13 is threadably connected with its internal threads 14 at the weapon barrel muzzle 11 of the weapon barrel 10. This known weapon barrel brake or brake device 13 comprises inclined transverse bores 15 through which the propellent gas which escapes out of the weapon barrel muzzle 11 can be deflected or turned and in consequence thereof there is exerted in known fashion a braking action upon the recoil motion of the weapon barrel 10 after the firing of each projectile or ammunition round.

This barrel muzzle brake or brake device 13 comprises a shoulder 16 at which bears a first disc or disc member 17. This first disc or disc member 17 possesses a sleeve or sleeve member 18 at which bears a second disc or disc member 19 in spaced relationship from the first disc or disc member 17. The weapon barrel muzzle brake 13 possesses at its rear end 13*a* an external thread or threading 20 upon which there is threaded a threaded ring or ring member 21 pressing both of the disc members 17 and 19 against the aforementioned shoulder 16 and thus pressing the second disc member 19 against the sleeve or sleeve member 18. A lock washer or other appropriate securing device 22 prevents unintentional loosening of the threaded ring or ring member 21.

Between both of the disc members 17 and 19 there is located a first ring or ring member 23 equipped with blindhole bores 24 and a second ring or ring member 25 which is devoid of any bores. Both of the rings or ring members 23 and 25 possess approximately the same external diameter and internal diameter, it being noted that the internal diameter of the rings 23 and 25 is here, for instance, essentially the same and the external diameter of the ring member 23 is slightly larger than the external diameter of the other ring member 25. Within each of the bores or bore members 24 there is located an associated compression or pressure spring 26 which bears at one end 26*a* against the base of the associated blindhole bore 24 and at its other end 26*a* against the second ring or ring member 25. These compression springs 26 strive to press the first ring member 23 against the first disc member 17 and the second ring member 25 against the second disc member 19.

Furthermore, in the first disc member 17 there are inserted a plurality of pin members or pins 27 or equivalent structure at one of their ends 27*a* and which bear at their other ends 27*b* upon the second disc member 19. At each of there pin members 27, which are disposed substantially parallel to the lengthwise or longitudinal axis 52 of the weapon barrel 10, there is secured a suitable resilient or spring element, here shown as a blade or leaf spring 28. Each of these blade or leaf springs 28 surrounds an associated pin member 27 throughout approximately one-half of the inner circumference of such related pin member 27 and also bears upon the neighboring pin member 27. The one end 28*a* of each blade or leaf spring 28 bears at the inner surface or side 23*a* of the first ring member 23. These blade or leaf spring members 28 are approximately of the same width as the sleeve member or sleeve 18 and thus also contact the second ring member 25.

The ring member 23 in conjunction with the other ring member 25 forms an inertia body 31. Depending upon the desired size or mass of the inertia body 31, in other words whether it should be smaller or larger, there is appropriately selected the outer circumference of the ring member 23 to be correspondingly larger or smaller, as the case may be. In FIG. 1 they have been shown with chain-dot or phatom lines the outer circumferences 29, 29′ and 29″ of the ring member 23 in different size variations. As to these three ring members 23 having the three different size circumferences 29, 29′ and 29″ it is possible, for instance, for the smallest ring member to weigh about 0.5 kilograms, the intermediately depicted ring member to weigh about 1 kilogram and the largest ring member to weigh about 1.5 kilograms.

Figure 3:
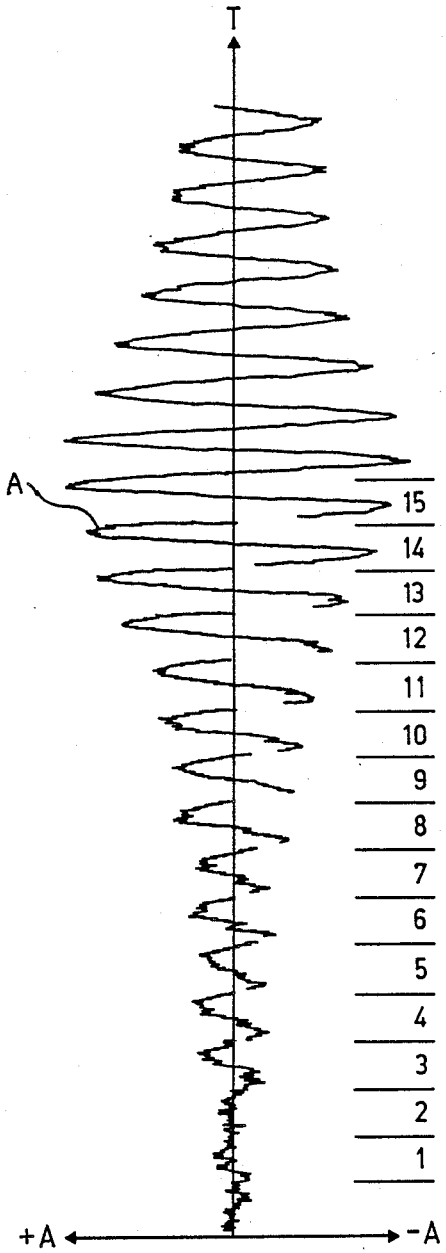
FIG. 3 is a diagram portraying the vibrations or oscillations which occur at the weapon barrel at the weapon barrel muzzle when such a weapon barrel vibration damping device is not provided for the firing weapon.

Having now had the benefit of the foregoing description of the vibration damping device or damper the mode of operation thereof will be considered and is as follows:

According to the showing of FIG. 3 the amplitudes A of the bending vibrations or oscillations at the barrel muzzle 11 of the weapon barrel 10, when these vibrations or oscillations are not damped, become somewhat greater after firing each projectile or ammunition round, so that there is to be expected a resonance oscillation. The individual fired shots or projectiles have been conveniently indicated in FIG. 3 by horizontal lines. The deflections of the weapon barrel 10 are given at the region of the barrel muzzle brake or brake device 13 in a suitable length dimension, such as millimeters. The inertia of both of the ring members 23 and 25 ensures that upon deflection or bending of the weapon barrel 10 the resilient or spring elements, here the blade or leaf springs 28 are bent and the ring members 23 and 25 shift relative to the weapon barrel 10 and both of the disc members 17 and 19. As a result the friction between both of the ring members 23 and 25 and the disc members 17 and 19 appreciably contributes to damping the bending vibrations or oscillations of the weapon barrel 10 since the kinetic energy of the weapon barrel is advantageously transformed through friction into thermal energy with the result that such kinetic energy is dissipated and the vibration motion of the weapon barrel 10 at least minimized.

The inventive vibration damping device or damper 30 essentially comprises both of the ring members 23 and 25 which collectively form the inertia body 31, and both of the disc members 17 and 19 in conjunction with the compression or pressure springs 26 form the brake or brake device 32 for the inertia body 31. The disc members 17 and 19 possess braking or brake surfaces 33 and the two ring members 23 and 25 likewise possess brake or braking surfaces 34. The compression springs 26 press the brake or braking surfaces 34 of the ring members 23 and 25 against the brake or braking surfaces 33 of the disc members 17 and 19.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. The combination with a firing weapon having a weapon barrel possessing a lengthwise axis and a weapon barrel muzzle, of a weapon barrel damping device provided at the weapon barrel muzzle for preventing substantially radially directed bending vibrations of the weapon barrel, which weapon barrel is secured at only one end thereof, during firing of projectiles from the weapon barrel, said weapon barrel damping device comprising:

an inertia body operatively connected with the weapon barrel muzzle for relative radial displacement between the weapon barrel and said inertia body under the action of the bending vibrations;

said inertia body possessing a substantially ring-shaped configuration and being arranged substantially coaxially with respect to the lengthwise axis of the weapon barrel;

resilient means operatively interconnecting the inertia body and said weapon barrel and urging said inertia body into said substantially coaxial position; and said resilient means substantially readily counteracting said relative radial displacement between said inertia body and said weapon barrel in order to thereby at least damp said bending vibrations.

2. The combination as defined in claim 1, wherein:

said resilient means comprises a plurality of blade springs counteracting said relative radial displacement between said inertia body and said weapon barrel.

3. The combination as defined in claim 2, wherein:

said substantially ring-shaped inertia body having an inner surface;

each of said blade springs having opposed ends;

means for securing each of said blade springs at one of said opposed ends at a predetermined position relative to the weapon barrel muzzle; and each of said blade springs being supported at its other end at said inner surface of the substantially ring-shaped inertia body.

4. The combination with a firing weapon having a weapon barrel possessing a lengthwise axis and a weapon barrel muzzle, of a weapon barrel damping device provided at the weapon barrel muzzle of preventing bending vibrations of the weapon barrel, which weapon barrel is secured at only one end thereof, during firing of projectiles from the weapon barrel, said weapon barrel damping device comprising:

an inertia body resiliently connected with the weapon barrel muzzle;

said inertia body possessing a substantially ring-shaped configuration and being arranged substantially coaxially with respect to the lengthwise axis of the weapon barrel;

resilient means for retaining the inertia body in said substantially coaxial position;

said resilient means comprising a plurality of blade springs;

said substantially ring-shaped inertia body having an inner surface;

each of said blade spring shaving opposed ends;

each of said base springs being secured at one of said opposed ends in a predetermined position relative to the weapon barrel muzzle;

each of said blade springs being supported at its other end at said inner surface of the substantially ring-shaped inertia body;

pin members arranged substantially parallel to the lengthwise axis of the weapon barrel;

two disc members rigidly secured to the weapon barrel muzzle;

said pin members being disposed between said two disc members; and each of said blade springs being secured at said one end thereof at an associated one of said pin members in said predetermined position relative to said weapon barrel muzzle.

5. The combination as defined in claim 1, further including:

a brake device for damping relative radial movement between the inertia body and the weapon barrel muzzle;

said brake device and said inertia body being provided with braking surfaces; and means for resiliently pressing the brake surfaces against one another.

6. The combination with a ring weapon having a weapon barrel possessing a lengthwise axis and a weapon barrel muzzle, of a weapon barrel damping device provided at the weapon barrel muzzle for preventing bending vibrations of the weapon barrel, which weapon barrel is secured at only one end thereof, during firing of projectiles from the weapon barrel, said weapon barrel damping device comprising:

an inertia body resiliently connected with the weapon barrel muzzle;

said inertia body possessing a substantially ring-shaped configuration and being arranged substantially coaxially with respect to the lengthwise axis of the weapon barrel;

resilient means for retaining the inertia body in said substantially coaxial position;

a brake device for damping relative movement between the inertia body an the weapon barrel muzzle;

said brake device and said inertia body being provided with braking surfaces;

means for resilient pressing the braking surfaces against one another;

said brake device comprising two disc members rigidly secured to the weapon barrel muzzle;

said substantially ring-shaped inertia body being located between said two disc members;

said inertia body comprising two ring members; and said resiliently pressing means pressing said two ring members against said disc members.

7. The combination as defined in claim 6, wherein:

one of said two ring members of said inertia body possesses a plurality of axially extending bores;

said resiliently pressing means comprising compression springs arranged in said axially extending bores; and said compression springs pressing both of said two ring members of the inertia body against both of the two disc members which are rigidly secured to the weapon barrel muzzle.

8. A weapon barrel damping device for use with a firing weapon having a weapon barrel possessing a lengthwise axis and a weapon barrel muzzle, for preventing substantially radially directed bending vibrations of the weapon barrel, during firing of projectiles from the weapon barrel, said weapon barrel damping device comprising:

an inertia body operatively connected with the weapon barrel muzzle for relative radial displacement between the weapon barrel and the inertia body under the action of the bending vibrations;

means operatively connecting said inertia body and the weapon barrel and countering relative radial displacement between said weapon barrel and said inertia body under the action of the bending vibrations;

said inertia body possessing a substantially ring-shaped configuration and being arranged substantially coaxially with respect to the lengthwise axis of the weapon barrel; and said operative connecting means constituting resilient connecting means urging the inertia body into said substantially coaxial position in order to thereby radially counteract and at least damp the bending vibrations.

* * * * *